United States Patent [19]

Wenk

[11] Patent Number: 4,898,412

[45] Date of Patent: Feb. 6, 1990

[54] TAMPER-PROOF BAG SEAL AND METHOD FOR MANUFACTURING THE SAME

[75] Inventor: Joseph H. C. Wenk, Huntington Bay, N.Y.

[73] Assignee: American Casting & Manufacturing Corp., Plainview, N.Y.

[21] Appl. No.: 200,936

[22] Filed: Jun. 1, 1988

[51] Int. Cl.[4] ..... B05D 33/34

[52] U.S. Cl. ..... 292/310; 292/DIG. 38; 29/33.52

[58] Field of Search ..... 292/310, 311, 312, 313, 292/317, 308, 309, DIG. 38; 24/30.5 R; 29/243.57, 33.52

[56] References Cited

U.S. PATENT DOCUMENTS

| | | | |
|---|---|---|---|
| 676,415 | 6/1901 | Brooks | 292/310 X |
| 3,117,812 | 1/1964 | Brooks et al. | 292/311 |
| 3,292,961 | 12/1969 | Moberg | 292/311 |
| 3,777,400 | 12/1973 | Kleny et al. | 24/305 R X |
| 4,001,919 | 1/1977 | Moberg et al. | 292/318 X |

*Primary Examiner*—Richard E. Moore
*Attorney, Agent, or Firm*—Hoffmann & Baron

[57] ABSTRACT

The present invention is a tamper-proof security seal which includes a shackling tape and a tape-gripping element with two deformable tape-gripping sections. The first gripping section includes a structural flap folded toward an inside bag-receiving side of the seal so that the fold is essentially concealed when the seal is used. The first section also includes an enlarged tooth integral with the first section to grip a bag around which the seal is applied. The second tape-gripping section has a plurality of inwardly pointing teeth inside the second section.

A method of manufacture of the security seal is also disclosed.

5 Claims, 3 Drawing Sheets

Fig. 3
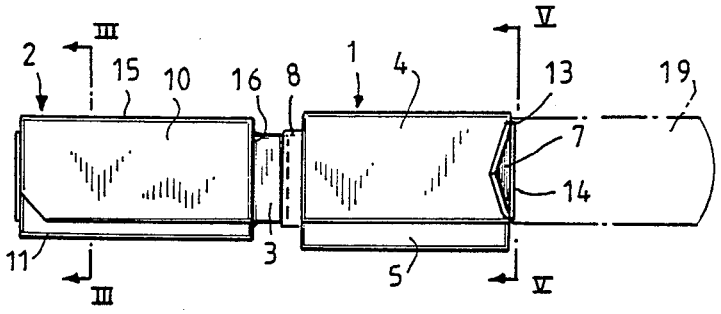
Fig. 4
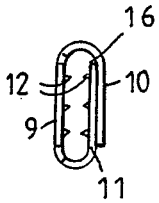
Fig. 5
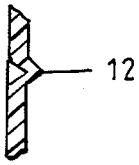
Fig. 6
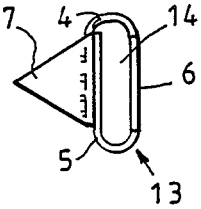
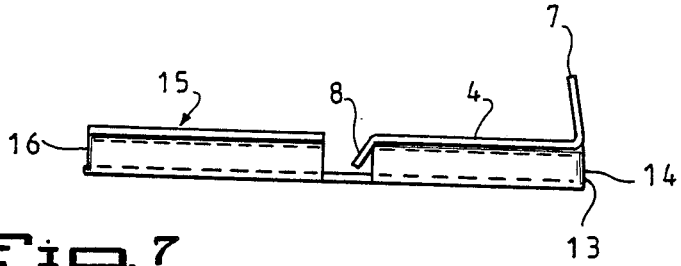
Fig. 7
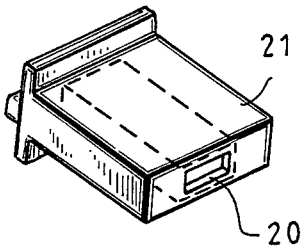
Fig. 8

TAMPER-PROOF BAG SEAL AND METHOD FOR MANUFACTURING THE SAME

BACKGROUND OF THE INVENTION

The present invention relates to seals for securely closing bags such as those used by banks, armored car companies, vending companies, telephone companies and cash and coin handlers. The function of the seal is to detect unauthorized access to the contents of the bag or pilferage and removal of some or all of tee contents without evidence that tampering has occurred. In another embodiment this invention can be used as a cable tie. More particularly, the present invention relates to security seals with enhanced strength and ease of detection of tampering and a method for manufacturing these security seals Prior art security seals exist which employ a tape as a shackle and a sealing element which can be deformed with a cinching tool.

In particular, U.S. Pat. No. 3,292,961 to Moberg discloses a bag seal with a deformable sealing block, a deformable sheet metal tape-gripping element with two portions and a length of tape with one end clinched within the first portion of the tape-gripping element. The tape-gripping element has a second portion to receive and grip the distal portion of the tape when the second portion is clinchingly deformed upon the tape. The second portion has an oblong passage and a reentrant wall portion constituting a bridge through which the distal portion of the tape is passed and the second portion extends into the sealing block. After the tape is engaged, the sealing block and the second portion therewithin are deformed However, the first tape-gripping element is constructed so that metal flaps are exposed on the outside of the seal when the seal is placed around a bag. In addition, a tab is provided which bulges in the direction of the bag and which is connected to the distal end of the first tape-gripping element. Teeth are provided on only one wall inside the oblong passage of the second portion and the tape is of fabric such as regenerated cellulose.

If metal seals have flap portions folded toward the outside of the seal so that the flap portions are exposed when the seal is placed around a bag, the flaps can be pried apart and later replaced without evidence of tampering. In addition, if the seal does not provide adequate means for strongly gripping the bag, the seal and its tape can be slipped off the bag and later replaced. Furthermore, if the seal does not grip the tape with sufficient strength, the tape can be pulled completely out of the seal. It is also important to supply a tape which is strong and resilient, and yet still can demonstrate tamper evidence.

In view of the above potential problems, it is apparent that the prior art does not achieve a security seal with a combination of features which include (i) a tape-gripping mechanism which cannot be pried apart and later replaced without evidence of tampering (ii) an enlarged tooth integral with a tape-gripping section to grip the bag so that the seal cannot be slipped off the bag;

(iii) horizontally opposed teeth inside the tubular structure of the second tape-gripping section to prevent the tape from being pulled out; and (iv) a polypropylene shackle tape which provides strength and resilience but will also show evidence of tampering.

Accordingly it is an object of the present invention to provide a security seal with enhanced strength and which has a metal seal which will evidence tampering.

It is another object of the present invention to provide a bag seal with greater tape pull-out resistance which will show tamper evidence.

A further object of the present invention is to provide a bag seal having a metal seal which cannot be pried open and later reclosed.

It is a still further object of the present invention to provide a bag seal with an adequate holding mechanism to engage an encircled bag and prevent the seal from being slipped off the bag.

Yet another object of the present invention is to provide a tape-gripping mechanism which prevents the tape from being pulled out of a seal while at the same time providing evidence of tampering.

Still another object of the present invention is to eliminate unnecessary tabs and provide an effective yet streamlined bag seal for purpose of economy, efficiency of manufacture, and ease of handling while at the same time providing a security seal with enhanced strength It is also an object of the present invention to provide a method of manufacture of the security seals.

SUMMARY OF THE INVENTION

The present invention is a security seal with enhanced strength and a method for making the security seal. The security seal comprises a length of shackling tape with a securing end and a distal end. The security seal has a bag engaging side and an outer side, and a tape-gripping element with two tape-gripping sections. The secured end of the tape is fixedly connected into the first tape-gripping section and the second tape-gripping section is adapted to receive the distal end of the tape. The second tape-gripping section is provided with a tape-gripping passage having a plurality of inwardly pointing teeth for engagement with all surfaces of the tape and is deformable for clinching and holding the tape.

The second tape-gripping section can be extended into a sealing block and the first tape-gripping section has a strong, enlarged tooth integral with it and projecting inward toward a bag-receiving side of the seal to grip a bag. In addition, the first tape-gripping section is folded in such a fashion that its metal flaps are folded toward the inside bag-receiving side of the seal so that the fold is essentially concealed when the seal is applied to a bag. The second tape-gripping section has a plurality of inwardly pointing horizontally opposed teeth in mating relationship on opposite sides inside the second tape-gripping section.

Another aspect of the present invention concerns a method of manufacturing the security seal. The method of manufacture comprises stamping a length of sheet metal to form interconnected blanks which have essentially flat rectangular first and second tape-gripping sections connected in a central area.

The first section has a first central area with two side flaps. One of these side flaps has a triangular area pointing in an opposite direction from the second section and this triangle will be bent in the manufacture process to form a projection which will grip a bag around which the security seal is placed. Another side flap of the first section has a tab which will be bent to close one end of the first tape-gripping section.

The second tape-gripping section has a second central area with a plurality of teeth projecting upward from its surface and a side flap with a plurality of teeth projecting upward, and another side flap opposite the side flap with projecting teeth.

The blanks are bent so that first and second interconnected tape-gripping sections are formed. When the second tape-gripping section is bent, a tape-receiving passage is formed with inwardly pointing horizontally opposed teeth in mating relationship on opposite sides inside its structure.

As a result of the present invention, a security seal with enhanced strength is provided which will evidence tampering.

In particular, the security seal of the present invention achieves secure, tamper-evident sealing which:

1. Has greater tape pull-out resistance;
2. Will exhibit evidence of an attempt at stretch tampering;
3. Has a metal seal with a concealed flap which cannot be pried open and later reclosed;
4. Includes a strong and substantial holding mechanism to engage an encircled bag and prevent the seal from being slipped off the bag;
5. Is economical and can be efficiently manufactured.

For a better understanding of the present invention, together with other and further objects, reference is made to the following description, taken together with the accompanying drawings, and its scope will be pointed out in the appended claims.

BRIEF DESCRIPTION OF THE DRAWINGS

FIG. 3 is a plan view of the blank formed into a tape-gripping element with two sections connected by a neck, with a first section capable of clinching a tape shackle and with a metal projection pointing so that it engages the fabric of a bag around which the shackle is placed and a second clinching section which can be pushed tightly into a deformable sealing element (FIG. 8), and a tape shackle inserted into the first section;

FIG. 4 is a cross sectional view of FIG. 3 taken along line III—III which shows a clinching portion of the tape-gripping element with opposing projections which firmly hold the tape shackle;

FIG. 5 is a cross sectional view of one of the opposing projections which hold the tape shackle;

FIG. 6 is a cross sectional view of the tape-clinching portion of the tape-gripping element taken along lines V—V showing the metal tooth projection;

FIG. 7 is a side view of the tape-gripping element showing the metal tooth projection;

FIG. 8 is a perspective view of a sealing block;

DETAILED DESCRIPTION

The illustrated seal comprises a shackling tape and a tape-gripping element.

The tape-gripping element is formed of sheet metal which is bendable and deformable by suitable bending and deforming tools and which tends strongly to retain a shape to which it is bent or deformed.

The tape-gripping element of the present invention includes two sections each of which receives an opposite end of a shackling tape.

Figure 1:
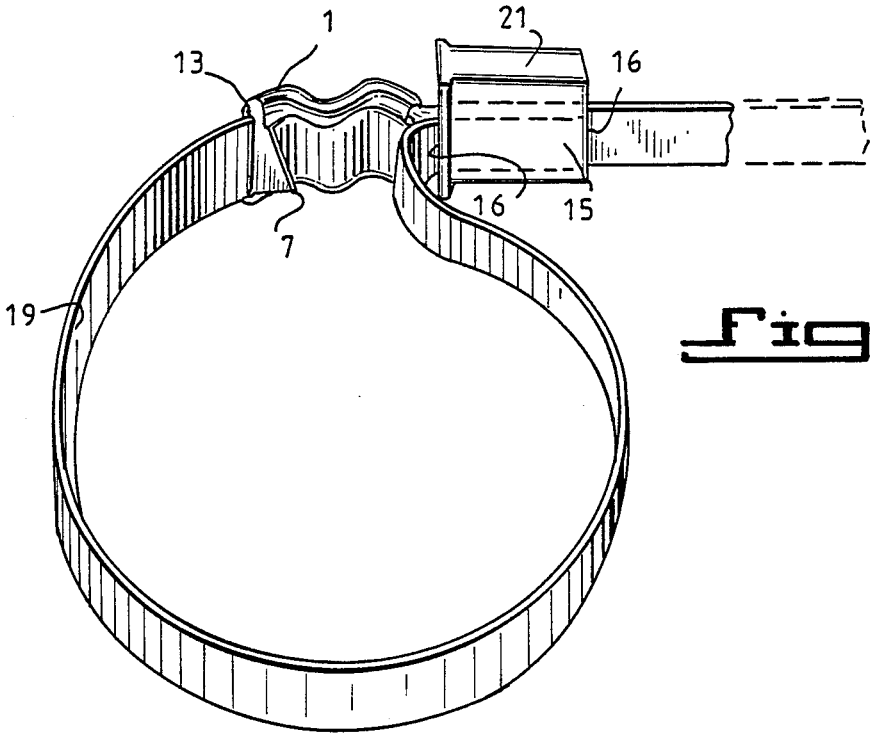
FIG. 1 is a perspective view of a tamper-proof bag seal assembly according to the present invention.
Figure 2:
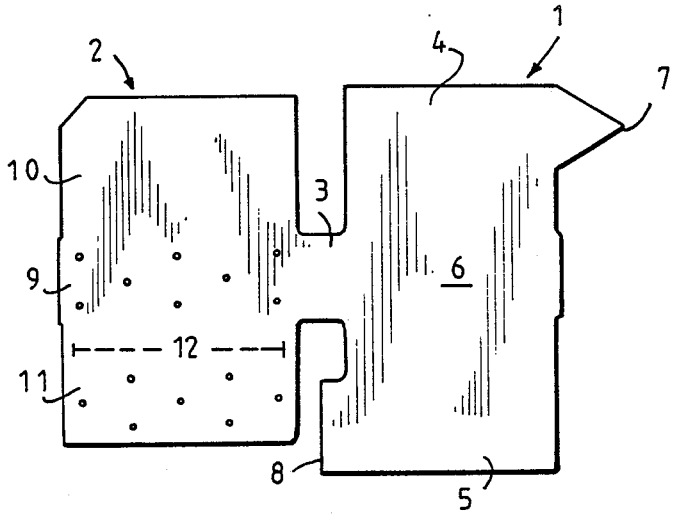
FIG. 2 is a plan view of a partially processed but still substantially flat sheet metal blank to be used in forming a tape-gripping element of a bag seal according to the present invention.

The tape-gripping element can be made by stamping and/or cutting a piece of metal into a substantially flat blank of a shape and condition shown in FIG. 2.

In that condition, the blank of FIG. 2 has a first tape-gripping section 1 and a second tape-gripping section 2 joined by a neck 3. The first section 1 has side flaps 4, 5 of a first central area 6. Side flap 4 has a triangular projection 7 pointing in the opposite direction from second section 2 and this triangular projection 7 can be bent thereafter upward from the plane of FIG. 2 to form an enlarged tooth projecting upward to a distance of about 0.180 in. to about 0.190 in. and preferably to a distance of 0.185 in. to grip a bag (not shown) which is being closed by the security seal. Side flap 5 has a tab 8 extending rearwardly toward the second section The first central area 6 of first section 1 is joined by neck 3 to a second central area 9 of second section 2. The second central area 9 has side flaps 10 and 11. Also as viewed in FIG. 2, side flap II and second central area 9 have a plurality of teeth 12 projecting upwardly from the surface of the plane of the blank illustrated in FIG. 2 to a height of at least 0.015 inches as shown in FIG. 5, and positioned so that when side flap II is folded over along a longitudinal axis to approach second central area 9, the projecting teeth 12 extend inwardly toward the second central area 9 and the projecting teeth !2 on second central area 9 to form opposed teeth on both surfaces in mating relationship so that each tooth fits cooperatively with a region on the opposite surface where no tooth is present, for gripping shackling tape 19 which is positioned between side flap 11 and second central area 9. A side view of the teeth after folding of the blank is shown in FIG. 4. An optional circular hole is provided centrally in neck 3 (not shown).

In the manufacture of the seal, the blank shown in FIG. 2, is bent by suitable metal-forming process from its FIG. 2 condition to the condition shown in FIGS. 3, 4, 6, and 7. Thus, as viewed in FIG. 3, side flaps 4 and 5 of the first section 11 are bent upwardly and inwardly in overlapping relationship to form a first tape-receiving passage 13. It will be noted that the folded configuration of the first tape-receiving passage 13 is such that the side flaps 4 and 5 when folded, close toward the inside bag-receiving side of the seal to deprive view of and access to the flaps when the seal is applied to a bag thereby eliminating one source of possible tampering.

In addition to the inward folding of side flaps 4 and 5, as shown in FIGS. 3 and 7 triangular projection 7 can be sharply deflected upwardly in the direction of an encircled bag to provide a single strong, enlarged tooth for improved gripping strength on the encircled bag. As a result of this unique design, a strong, deep-penetrating tooth can be provided for more effective bag-gripping capability. Tab 8 on side flap 5 is bent downwardly toward neck 3 to effectively close one end of the first tape-receiving passage 13 as shown in FIGS. 3 and 7. The closure of the first tape-receiving passage insures that when a shackling tape is urged into the passage, the tape is inserted to the proper distance. FIG. 6 shows a cross sectional view through the open end 14 of the first tape-receiving passage 13 with triangular area 7 deflected so as to grip an encircled bag.

An end portion of the shackling tape 19 is inserted through opening 14 into the first tape-receiving passage 13, up to the tab 8 which terminates passage 13. The thus assembled first section 1 is secured to the tape by deforming the first section 1 with a cinching tool known in the art, so that the end portion of the shackling tape is firmly gripped by the first section.

As shown in FIG. 3, in the second section 2, side flap 11 is bent upwardly and inwardly toward second central area 9, and side flap 10 is bent upwardly and inwardly in overlapping relationship to side flap 11 to form a second tape-receiving passage 15 with opening 16 of a sealing tape-clinching portion in second section 2.

FIG. 4 shows a cross-sectional view of the second tape-receiving passage 16 with opposed teeth 12 which were previously molded on side flap 11 and second central area 9.

A sealing block 21 of suitable material (FIG. 8) known in the art is optionally provided, with a cross sectionally rectangular, longitudinal passage 20 extending therethrough. This passage is of such size as to receive the second tape-receiving passage therewithin with friction fit.

The distal end of a tape is inserted into the second tape-receiving section, and the section is deformed with a deforming tool. The actual gripping or locking action holding the tape in the second tape-receiving passage 15 is enhanced by the teeth 12 in mating configuration within the second tape-receiving passage 15. This design produces substantially greater holding strength as well as shredding of the tape if enough reverse pressure is applied to remove the tape thus showing positive tamper evidence.

The shackling tape is preferably made of polypropylene. Polypropylene maintains its strength after repeated flexing, and is flexible and resilient. It will also shred when sufficient reverse pull is applied and thereby show tamper evidence To use the seal, the tape is encircled around the neck of a bag. The distal end of the tape is passed through opening 16 of second tape-receiving passage 15, and the tape is extended through the second tape-receiving passage, protruding out the opposite end. The tape is pulled by the protruding end tightly around the bag and the second tape-receiving passage is tightened and cinched with a sealing tool in a manner known in the art. Optionally, the second tape-receiving passage may be inserted into a deformable sealing block before cinching. The cinching of the second tape-receiving passage 15, engages the teeth 12 located therein. The polypropylene tape has sufficient "memory" that it continually engages the teeth and the tape is thereby prevented from being pulled out of the seal. If sufficient force is exerted to stretch the tape to gain access to the bag, the tape will shred and thereby exhibit evidence of tampering.

Figure 9:
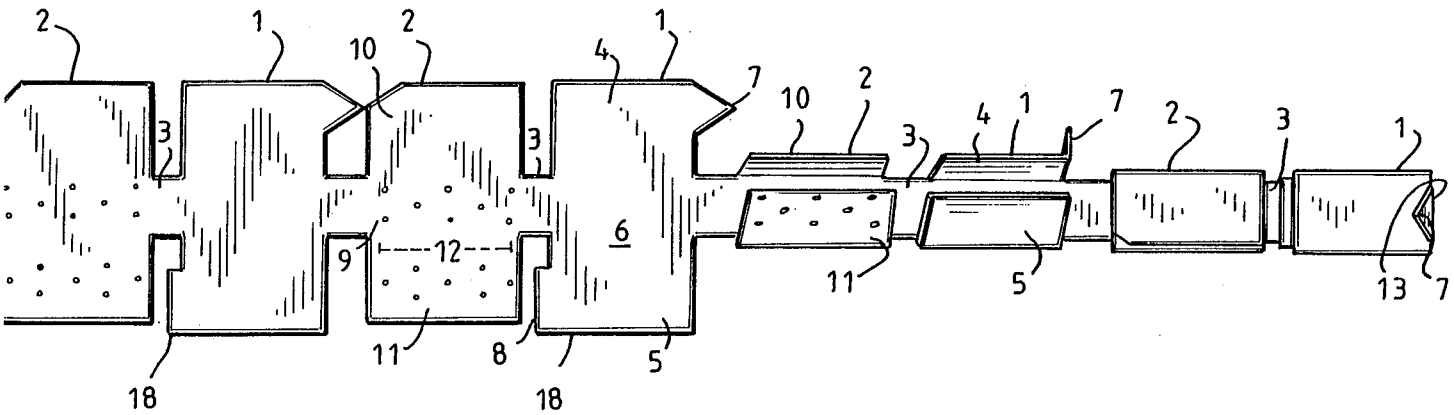
FIG. 9 illustrates the manufacture of the security seal tape-gripping element.

The manufacture of the security seal tape-gripping element is illustrate in FIG. 9.

Referring now to FIG. 9, a length of sheet metal 17 is provided and supported in a longitudinal orientation. The sheet metal length is stamped to form substantially flat linearly connected blanks 18. The blanks are stamped to have essentially rectangular sections including a first tape-gripping section 1 and second tape-gripping section 2 connected in a central area by a neck 3. The first section 1 has a first central area 6 with side flaps 4, 5. Side flap 4 has a triangular projection 7 pointing in an opposite direction from the second section. Side flap 5 has a tab 8 extending rearwardly toward the second section in the region of the neck. The second section 2 has a second central area 9 with a plurality of teeth 12 projecting upward from its upper surface to a height of at least 0.015 in. The second section 2 also has side flaps 10, 11 adjoining the second central area 9 and opposite each other. Side flap 11 has a plurality of teeth projecting upward from its upper surface to a height of at least 0.015 in.

In manufacture, the blanks 18 are subjected to deformation so that side flaps 4, 5 are bent upwardly and inwardly in overlapping relationship over the first central area 6 to form a first tape-gripping section with a first tape-receiving passage 13 with the triangular projection 7 connected to the first side flap 4 deflected upwardly from the surface of the plane of the first passage and the tab connected to side flap 11 bent downwardly from the plane of the first tape-gripping passage toward the neck effectively closing an end of the first passage.

In the second section 2, side flaps 10, 11 are bent upwardly and inwardly in overlapping relationship over the second central area 9 to form a second tape-gripping section which includes a second tape-receiving passage 15. Side flap 11 is positioned over the second central area 9 so that the teeth projecting upward from the upper surface of the second central area 9 and the teeth projecting from the surface of side flap 22 are disposed in mating configuration so that each tooth approaches a region on the opposite area where no tooth is present on the opposite wall inside the second passage 15.

The linearly connected stamped and bent blanks are cut apart to provide tape-gripping elements comprising a first tape-gripping section 1 connected by a neck 3 to a second tape-gripping section 2.

The end of a length of shackling tape 19 is inserted into the first tape-receiving passage 13 as shown in FIG. 3 and the tape is fixedly attached in the first tape-gripping section. Optionally, the second tape-gripping section may be inserted into a deformable sealing block. Thus is provided a manufactured security seal in accordance with the present invention.

While there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

What is claimed is:

1. A bag seal for securing closure of a foldable bag comprising a tape with a secured end and a distal end and a bag engaging side and an outer side and a tape-gripping element having two tape gripping sections, a first tape-gripping section into which said secured end of the tape is fixedly connected said first tape gripping section which comprises fold-over portions arranged to fold over said tape and be compressed thereagainst on said bag-engaging side, one of said foldover portions further comprises a projection adapted to be deflected outwardly from said fold-over portion in tape-engaging condition so that said projection is secured against a bag being secured by said seal; and a second tape-grinding section adapted to receive said distal end of said tape said second tape-gripping passage being initially open for entry of said distal end of said tape, said second tape-gripping passage having a plurality of opposed inwardly pointing teeth in mating relationship for engagement with the surface of each side of said tape, and being deformable for compression against said tape.

2. The bag seal of claim 1 wherein one of said fold-over portions further comprises a tab arranged to be deflected downwardly toward said passage thereby obstructing passage of said tape past said tab.

3. The bag seal of claim 1 which further comprises a seal block having a passage adapted to receive said second tape-gripping section by friction fit, said seal block being made of a material capable of deformation about said second tape-gripping section whereby attempt to remove said seal would result in detectable destruction of said block.

4. The bag seal of claim 1 wherein said tape is polypropylene having a strength and physical appearance which results in detectable destruction upon attempted removal from one of said first and second tape-gripping sections.

5. A method of making a metal tape-gripping element for a security seal comprising:

a. providing substantially flat sheet metal blanks having essentially rectangular first and second sections, said first section having a first central area with a side flap area on each of two opposite sides, a first side flap area having a triangular projection connected to the first side flap area and pointing in an opposite direction from the second rectangular section, a second side flap area having a tab extending toward the second section, said second section having a second central area with a plurality of teeth projecting upward from its upper surface to a height of at least about 0.015 in. and a third side flap area with a plurality of teeth projecting upward from its upper surface to a height of at least 0.015 in., a fourth side flap area located on the opposite side of the second central area from the third side flap, b. bending the blanks so that the first and second side flaps are bent upwardly and inwardly in overlapping relationship over the first central area to form a first tape-gripping section comprising a first passage, including bending the triangular projection connected to the first side flap outward from the passage and bending the tab connected to the second side flap inwardly toward the passage to effectively close an end of the first passage; bending the third and fourth side flaps upwardly and inwardly in overlapping relationship over the second central area to form a second tape-gripping section comprising a second passage with third and fourth side flaps positioned so that the plurality of teeth projecting upward from the upper surface of the second central area and the plurality of teeth projecting from the surface of third side flap are opposed on opposite walls inside the second passage;

c. separating the linearly connected stamped and bent blanks to provide tape-gripping elements comprising first and second tape-gripping sections;

d. inserting an end of a length of shackling tape into the first tubular passage of the first tape-gripping section; and e. deforming the thus assembled first tape-gripping section to secure tape therein.

* * * * *